US005810064A

United States Patent [19]

Sanderson et al.

[11] Patent Number: 5,810,064

[45] Date of Patent: Sep. 22, 1998

[54] GOLF CLUB TRAVEL BAG

[75] Inventors: David B. Sanderson, Villa Park; Carl Massano, Yorba Linda, both of Calif.

[73] Assignee: SKB Corporation, Orange, Calif.

[21] Appl. No.: 798,274

[22] Filed: Feb. 14, 1997

[51] Int. Cl.[6] ..... A63B 55/08; A63B 57/00; A45C 5/14

[52] U.S. Cl. ..... 150/159; 206/315.4; 206/315.5

[58] Field of Search ..... 206/315.2–315.8, 206/279, 294, 315.1; 150/159, 117; 190/109, 110, 111; 36/135

[56] References Cited

U.S. PATENT DOCUMENTS

| | | | |
|---|---|---|---|
| D. 258,703 | 3/1981 | Ogle et al. | D3/36 |
| D. 333,038 | 2/1993 | Collins | D3/36 |
| D. 345,255 | 3/1994 | Hughes | D3/77 |
| D. 350,435 | 9/1994 | Smith, IV | D3/261 |
| D. 352,394 | 11/1994 | Deioma et al. | D3/261 |
| D. 354,851 | 1/1995 | Smith et al. | D3/254 |
| D. 357,351 | 4/1995 | Kelsall | D3/261 |
| 1,632,442 | 6/1927 | Grubb . | |
| 1,676,592 | 7/1928 | White | 206/315.5 |
| 2,130,502 | 9/1938 | Lindemann | 150/117 X |
| 2,438,078 | 3/1948 | Sutphen | 206/315.3 X |
| 2,520,226 | 8/1950 | Smith | 280/51 |
| 2,718,251 | 9/1955 | Barbato | 150/159 |
| 2,760,782 | 8/1956 | Hartzell | 206/315.6 X |
| 2,767,758 | 10/1956 | Haynes | 206/315.1 |
| 3,316,951 | 5/1967 | Jacobson . | |
| 3,410,376 | 11/1968 | Benzel | 190/110 |
| 4,119,127 | 10/1978 | Klug | 206/315.1 |
| 4,126,256 | 11/1978 | McGruder | 206/294 |
| 4,182,391 | 1/1980 | Kjose | 206/315.5 X |
| 4,220,950 | 9/1980 | Cordasco | 206/315.4 X |
| 4,319,616 | 3/1982 | Light | 206/315.6 X |
| 4,378,866 | 4/1983 | Pelavin | 206/315.1 |
| 4,383,563 | 5/1983 | Kirchhoff, Jr. | 206/315.5 X |
| 4,453,623 | 6/1984 | Horii | 190/110 X |
| 4,480,774 | 11/1984 | Smith et al. | 224/205 |
| 4,657,135 | 4/1987 | Kjose | 206/315.5 X |
| 4,693,402 | 9/1987 | Comeau | 224/215 |
| 4,746,159 | 5/1988 | Webb et al. | 294/147 |
| 4,767,001 | 8/1988 | Kim | 206/315.3 |
| 4,805,748 | 2/1989 | Gerch | 190/103 |
| 4,805,749 | 2/1989 | Gerch | 190/111 |
| 4,817,802 | 4/1989 | Pratt | 206/579 |
| 4,830,154 | 5/1989 | Gerch et al. | 190/103 |
| 4,905,827 | 3/1990 | Kim | 206/315.5 X |
| 4,951,818 | 8/1990 | Johnson | 206/315.1 |
| 4,984,662 | 1/1991 | Jacober | 190/107 |
| 5,012,921 | 5/1991 | Becker | 206/315.1 |
| 5,071,126 | 12/1991 | Baugh | 273/74 |
| 5,090,526 | 2/1992 | Jacober | 190/107 |
| 5,094,344 | 3/1992 | Savage | 206/315.1 |
| 5,168,992 | 12/1992 | Bowdy | 206/315.5 X |
| 5,228,547 | 7/1993 | Yoo | 190/103 |
| 5,265,894 | 11/1993 | Dunn | 150/159 X |
| 5,289,906 | 3/1994 | Guidi | 190/107 |
| 5,356,013 | 10/1994 | Deioma et al. | 206/579 |
| 5,367,794 | 11/1994 | Adelstein et al. | 36/135 |
| 5,390,786 | 2/1995 | Challoner et al. | 206/278 |
| 5,413,199 | 5/1995 | Clement | 190/108 |
| 5,431,265 | 7/1995 | Yoo | 190/103 |
| 5,515,897 | 5/1996 | Fehan | 206/315.4 X |
| 5,551,561 | 9/1996 | Macrae et al. | 206/315.3 |

FOREIGN PATENT DOCUMENTS

| | | | |
|---|---|---|---|
| 226654 | 6/1958 | Australia | 206/315.3 |
| 8802349 | 4/1989 | Netherlands | 205/279 |
| 689853 | 4/1953 | United Kingdom | 206/315.3 |

*Primary Examiner*—Sue A. Weaver
*Attorney, Agent, or Firm*—Lyon & Lyon LLP

[57] ABSTRACT

A golf club travel bag comprises a generally parallelpiped shaped bag body having top, bottom, side, front and back panels preferably formed from foam padding interposing a knit backing and a ballistic nylon shell. An inset shoe case recesses into the travel bag from the front panel to maintain a substantially streamline outer surface. A generally rectangular flap cut into of the front panel operably covers the shoe case and provides access to the inset shoe case. The inset shoe case preferably includes a spike guard.

21 Claims, 2 Drawing Sheets

GOLF CLUB TRAVEL BAG

FIELD OF THE INVENTION

This invention relates to golf bags and, more particularly, to a golf club travel bag that facilitates the transportation of golf clubs and accessories.

BACKGROUND OF THE INVENTION

A variety of golf club travel bags are known in the art. The travel bags range from thin nylon shells to hard cover cases. The thin nylon shell bags are desirable because they are light weight and easy to use. However, the thin nylon shell bags provide little, if any, protection for the golf clubs. The hard shell cases, on the other hand, provide a great deal of protection for the clubs. In addition, the hard shell cases are capable of carrying accessory items such as shoes. Although possessing many advantages, the hard shell cases are heavy and generally cumbersome to use and, thus, less desirable.

Soft or padded shell cases have grown in popularity due to their light weight construction and their ability to provide the golf clubs greater protection than the nylon shell bags. Like the hard shell cases, the soft shell cases are also capable of carrying other items such as shoes. However, to carry other items such as shoes, the soft shell cases tend to utilize outwardly extending pockets that tend to snare during transport and, thus, increase the likelihood that the soft shell cases will tear.

Therefore, it would be desirable to have a golf club travel bag that is relatively light weight, that provides sufficient protection for the golf clubs, that is capable of carrying additional items including golf shoes, and that is constructed in a manner that makes it less susceptible to tearing.

SUMMARY OF THE INVENTION

The golf club travel bag of the present invention is a relatively light weight travel bag that provides sufficient protection for the golf clubs while being capable of carrying additional items including golf shoes and being constructed in a manner that is less susceptible to tearing. It preferably comprises a generally parallelpiped shaped bag body formed from elongated front, rear, and left and right side panels and having a generally flat bottom portion and arcuate top portion. The panels preferably include a durable knit backing internal to the bag, a durable external shell constructed from ballistic nylon and a layer of foam padding interposing the knit backing and the nylon shell.

A zipper is sewn into the right side panel and extends along the length of right side panel to expose the interior of the travel bag and allow a golf bag and a set of golf clubs to be placed inside of the travel bag. An inset shoe case is recessed into the travel bag from the front panel adjacent the top. A generally rectangular flap cut into of the front panel operably covers the shoe case. The flap, which is integral with the front panel along the bottom of the flap, is operably connected to the front panel via a zipper. In operation, the zipper is undone to provide access to the inset shoe case.

The interior of the inset shoe case includes recessed bottom, top and side walls and a back panel attached to the bottom, top and side walls. The back panel preferably includes a spike guard. The bottom, top and side walls are constructed such that the back panel is gradually recessed further inwardly as the back panel extends from the bottom wall to the top wall. This construction provides sufficient space to store a pair of golf shoes in the inset case while maintaining the streamline configuration of the bag and, thus, reducing the likelihood of snares and resultant tears.

The inset shoe case is preferably located adjacent the top of the bag to prevent the shoe case from interfering with a golf bag stored therein. The location of the shoe case advantageously reduces jostling of the club heads, and resultant damage thereto, during transport.

An object of this invention is to provide an improved golf club travel bag.

Further objects and advantages of the present invention will become apparent from a consideration of the drawings and ensuing description.

DESCRIPTION OF THE PREFERRED EMBODIMENT

Figure 1:
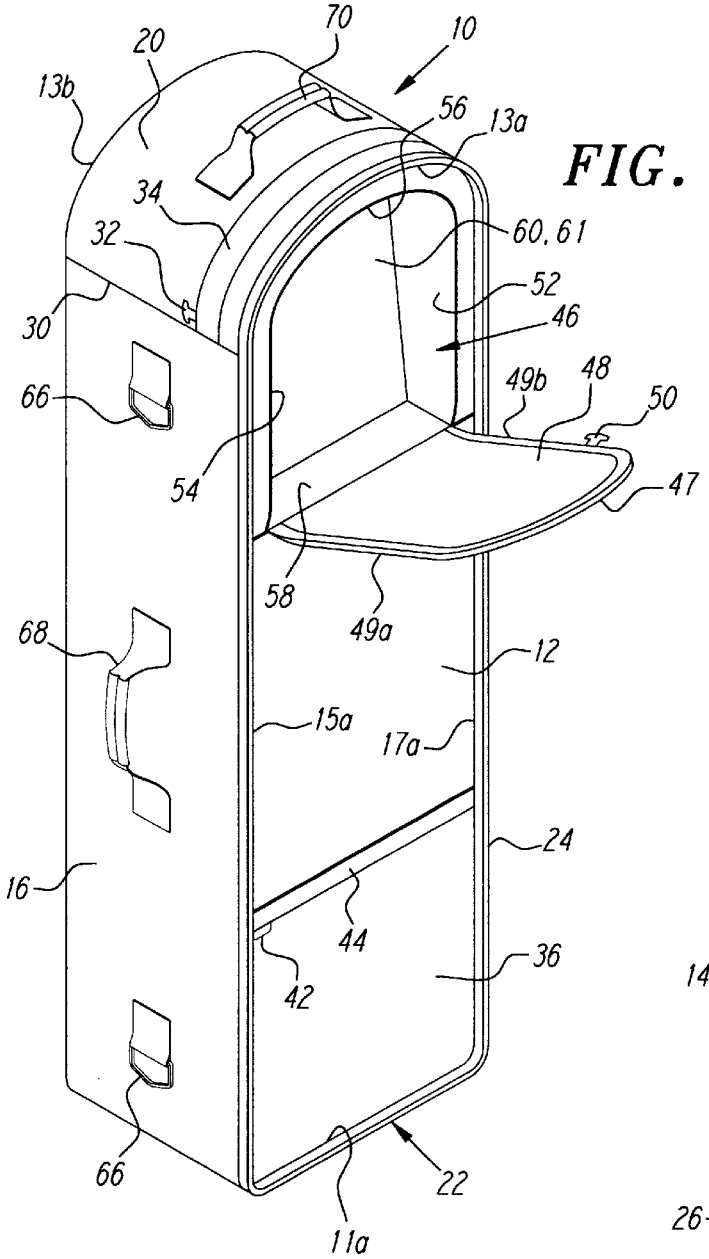
FIG. 1 is a perspective view of a golf club travel bag of the present invention.
Figure 2:
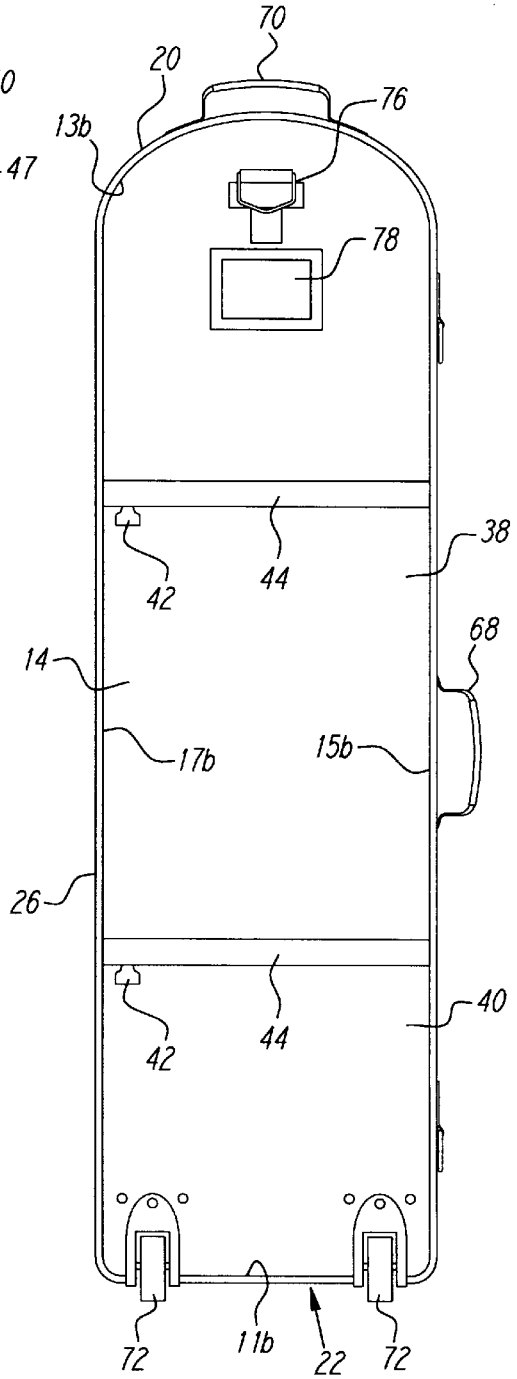
FIG. 2 is a back view of the golf club travel bag.
Figure 3:
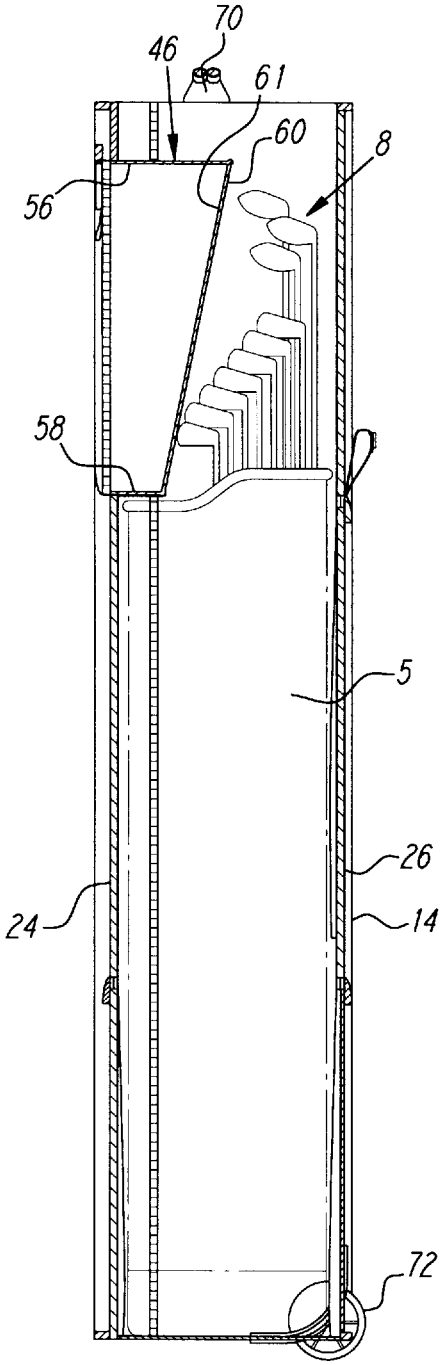
FIG. 3 is a cross-sectional view of the golf club travel bag including a golf club bag with a set of golf clubs positioned therein.
Figure 4:
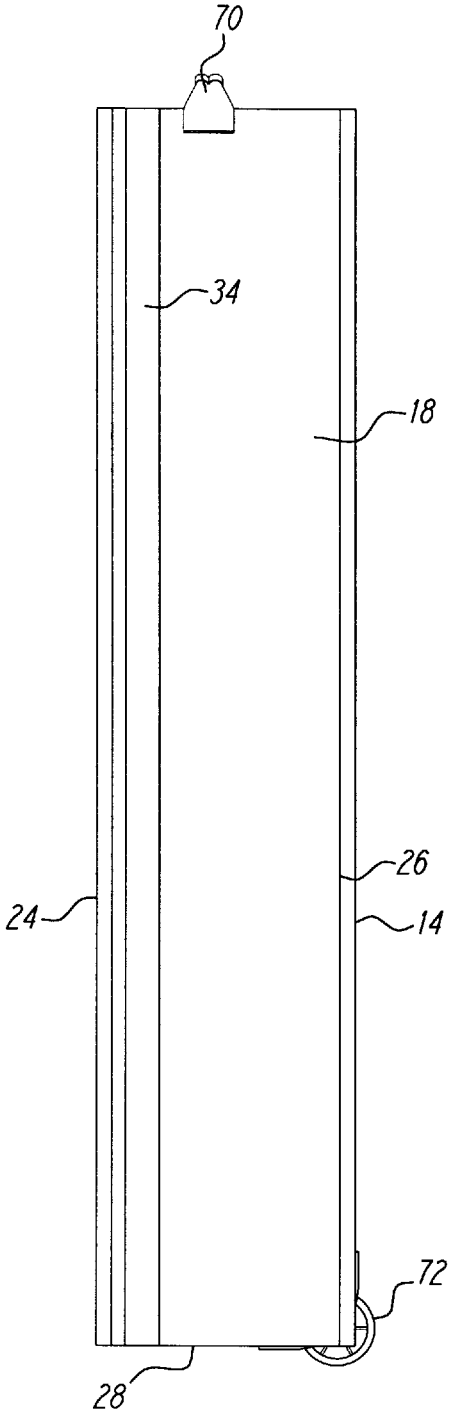
FIG. 4 is a right side view of the golf club travel bag.

Referring now in detail to the drawings, therein illustrated is a novel golf club travel bag 10. The travel bag 10 is a generally parallelpiped shaped bag body with elongated front, rear, and left and right side panels 12, 14, 16 and 18. The panels 12, 14, 16 and 18 preferably comprise a durable knit backing, internal to the bag 10, a durable external shell constructed from ballistic nylon and a layer of foam padding interposing the knit backing and the nylon shell.

The front and rear panels 12 and 14, which are generally rectangularly shaped, each include a straight bottom edge 11*a* and 11*b*, an arcuate top edge 13*a* and 13*b* and straight left and right side edges 15*a* and 15*b* and 17*a* and 17*b*. The left and right side panels 16 and 18, which are also generally rectangularly shaped, are sewn to the front and rear panels 12 and 14 forming web bound continuous seams 24 and 26. The left side panel 16 is sewn to the bottom edges 11*a* and 11*b* of the front and rear panels 12 and 14 forming a square or flat shaped bottom 22 to the travel bag 10. The remainder of the left side panel 16 is sewn up along the left side edges 15*a* and 15*b* of the front and rear panels 12 and 14.

The right side panel 18 attaches to the left side panel 16 at a seam 28 adjacent the bottom edges 11*a* and 11*b* of the front and rear panels 12 and 14. The right side panel 18 is sewn to the right side edges 17*a* and 17*b* and the arcuate top edges 13*a* and 13*b* of the front and rear panels 12 and 14. Attaching the right side panel 18 to the arcuate top edges 13*a* and 13*b* of the front and rear panels 12 and 14 forms an arcuate shaped top 20 to the travel bag 10. The left and right side panels 16 and 18 reattach at a seam 30 adjacent to the top edges 13*a* and 13*b* of the front and rear panels 12 and 14.

A main zipper 32 is sewn into the right side panel 18 dividing it into two parts. The zipper 32 extends along the length of the right side panel between the seams 28 and 30 adjacent the top 20 and bottom 22 of the bag 10. Preferably, the zipper 32 is a continuous coil zipper and includes a weather flap 34 that extends along the full length of the zipper 32. In operation, the zipper 32 is opened to expose the interior of the travel bag 10 and allow a golf bag 5 and a set of golf clubs 8 to be placed inside of the travel bag 10.

Three stream line storage pockets 36, 38 and 40 are sewn into the front and rear panels 12 and 14, two on the rear panel 14 and one on the front panel 12. Each of the storage pockets 36, 38 and 40 has a zipper 42 attached to the top of the pockets 36, 38 and 40. The zipper 42 on each pocket also includes a (whether) flap 44 that extends along the full length of the zipper 42. As noted, the storage pockets 36, 38 and 40 are stream-lined such that they do not protrude or extend outwardly from the front and rear panels 12 and 14. This pocket configuration maintains the substantially flat surface of the front and rear panels 12 and 14 and reduces the likelihood of snares and resultant tears in the front and rear panels 12 and 14.

An inset shoe case 46 is recessed from the front panel into the interior of the travel bag 10 adjacent the top 20 of the travel bag 10. A generally rectangular flap 48 cut out of the front panel 12 operably covers the shoe case 46. The flap 48 has an arcuate top edge 47 and side edges 49*a* and 49*b*. The flap 48 is integral with the front panel 12 along its bottom and is operably connected to the front panel 12 along its top and side edges 47, 49*a* and 49*b* via a zipper 50. In operation, the zipper 50 is undone to provide access to the inset shoe case 46.

The interior of the inset shoe case 46 includes recessed bottom, top and side walls 58, 56, 52 and 54 and a back panel 60 attached to the bottom, top and side walls 52, 54, 56 and 58. The top wall 58 is preferably arcuate to conform to the profile of the top 20 of the travel bag 10. The bottom, top and side walls 58, 56, 52 and 54 are constructed such that the back panel 60 is gradually recessed further inwardly as the back panel 60 extends from the bottom wall 58 to the top wall 56. This construction provides sufficient space to store a pair of golf shoes in the inset case 46 while maintaining the generally flat or streamline configuration of the outer surface of the bag 10 and, thus, reducing the likelihood of snares and resultant tears.

Preferably, the back panel 60 of the inset shoe case 46 includes a spike guard 61 attached thereto. The spike guard 61 is preferably constructed from hard plastic or other material suitable to prevent shoe spikes from piercing the back panel 60 and damaging any golf clubs that may be stored in the bag 10.

The inset shoe case 46 is preferably located adjacent the top 20 of the bag 10 to prevent the shoe case 46 from interfering with a golf bag stored therein. The location of the shoe case 46, which reduces the space in the top 20 of the bag 10 wherein the golf club heads are preferably located, advantageously reduces jostling of the club heads, and resultant damage thereto, during transport.

To aid in carrying the travel bag 10, a shoulder strap (not shown) is attached to the left side panel 16 via a pair of hooks 66 strategically located adjacent to the top and bottom 20 and 22 of the bag 10. A loading handle 68 is also attached to the left side panel 16 midway between the top and bottom 20 and 22 of the bag 10. A tow handle 70 attached to the top 20 of the bag 10 enables the travel bag 10 to be towed on a pair of easy glide wheels 72 attached to the bag 10 adjacent the bottom edge 11*b* of the rear panel 14 . The rear panel 14 is provided with an identification holder 78, and an additional hook 76, which may be used, for example, to store the bag.

Thus, the golf club travel bag 10 of the present invention provides many benefits over the prior art. While the above description contains many specificities, these should not be construed as limitations on the scope of the invention, but rather as an exemplification of one preferred embodiment thereof. Many other variations are possible.

Accordingly, the scope of the present invention should be determined not by the embodiments illustrated above, but by the appended claims and their legal equivalents.

What is claimed is:

1. A golf club travel bag comprising:

a flexible bag body having an outer surface that is substantially flat and an inner region adapted to receive a golf bag and a plurality of golf clubs; and an inset shoe case extending inwardly into said bag body from said outer surface, an inner back wall of the inset shoe case being sufficiently hard to prevent shoe spikes from penetrating the inner back wall.

2. The golf club travel bag of claim 1, wherein said bag body is generally parallelpiped shaped.

3. The golf club travel bag of claim 2, wherein said bag body includes an arcuate top portion.

4. The golf club travel bag of claim 1, wherein said bag body comprises first and second side panels and front and rear panels attached to said first and second side panels.

5. The golf club travel bag of claim 4, wherein said first side panel forms a generally flat bottom portion with said front and rear panels, and wherein said second side panel forms a generally arcuate top portion with said front and rear panels.

6. The golf travel bag of claim 4 wherein said side panels and said front and rear panels comprise foam padding.

7. The golf club travel bag of claim 1, wherein the inner back wall of said inset shoe case is coupled to recessed top, bottom, and side walls.

8. The golf club travel bag of claim 7, wherein said back wall extends further inwardly into said bag body as said back wall extends between said bottom and top walls.

9. The golf club travel bag of claim 7, wherein said bag body further comprises a front panel and a cover flap cut into said front panel and operably connected to said inset shoe case.

10. The golf travel bag of claim 1 wherein the bag body further comprises foam padding interposing a nylon shell and a knit backing.

11. A golf club travel bag comprising a generally parallelpiped shaped flexible bag body having top, bottom, front, back, and first and second side panels, said bag body being adapted to receive a golf bag and a plurality of golf clubs, and an inset shoe case extending inwardly from said front panel into said bag body, said inset shoe case having an inner back wall that is sufficiently hard to prevent shoes spikes from penetrating the inner back wall.

12. The golf club travel bag of claim 11, further comprising a cover flap cut into said front panel adjacent said inset shoe case.

13. The golf club travel bag of claim 12, wherein said flap has a bottom portion integral with said front panel and top, first side and second side edges operably connected to said front panel.

14. The golf club travel bag of claim 11, further comprising a substantially flat outer surface.

15. The golf club travel bag of claim 11, wherein said inset shoe case comprises interconnected recessed top, bottom, side and back walls.

16. The golf club travel bag of claim 15, wherein said back wall extends further inwardly into said bag body as said back wall extends between said bottom and top walls.

17. The golf club travel bag of claim 15, further comprising a cover flap cut into said front panel and operably connected to said inset shoe case.

18. The golf travel bag of claim 11 wherein said side panels and said front and back panels comprise foam padding.

19. The golf travel bag of claim 18 wherein the foam padding interposes a durable knit backing and a nylon shell.

20. A golf club travel bag comprising a top, substantially arcuate surface;

a bottom surface provided with two wheels, said top and bottom surfaces being coupled via side, front and back surfaces, said top, bottom, front, back and side surfaces forming a generally parallelpiped flexible bag body for accommodating a golf bag and a plurality of golf clubs, and an inset shoe case extending inwardly from said front surface into said bag body, said inset shoe case having a sufficient depth and including a cover flap integrally formed with said front surface to maintain a flat outer surface of said front surface when shoes are received in the inset shoe case, an inner back wall of the inset shoe case being sufficiently hard to prevent shoe spikes from piercing the golf club travel bag.

21. The golf travel bag of claim 20 wherein the bag body further comprises foam padding interposing a nylon shell and a knit backing.

* * * * *